United States Patent [19]

Miller

[11] Patent Number: 4,932,498

[45] Date of Patent: Jun. 12, 1990

[54] GUTTER GUARD

[76] Inventor: James W. Miller, 5496 Wales Ave., Pensacola, Fla. 32506

[21] Appl. No.: 396,350

[22] Filed: Aug. 21, 1989

[51] Int. Cl.[5] ..... E06C 7/48

[52] U.S. Cl. ..... 182/214; 182/107; 182/82; 182/229; 248/48.2; 248/210

[58] Field of Search ..... 182/107, 214, 229, 82; 248/48.2, 210; 52/11

[56] References Cited

U.S. PATENT DOCUMENTS

| | | | |
|---|---|---|---|
| 2,172,796 | 9/1939 | Krasin | 182/229 |
| 2,495,408 | 1/1950 | Christoffersen | 182/229 |
| 4,306,632 | 12/1981 | Brown | 182/229 |
| 4,311,210 | 1/1982 | Jackson | 182/107 |
| 4,446,945 | 5/1984 | Anderson | 182/229 |
| 4,714,136 | 12/1987 | Morin | 182/214 |
| 4,765,439 | 8/1988 | Kresmery | 182/214 |
| 4,813,515 | 3/1989 | Wigington | 182/214 |

*Primary Examiner*—Reinaldo P. Machado

*Attorney, Agent, or Firm*—H. Jay Spiegel & Associates

[57] ABSTRACT

The present invention relates to an improved device designed to be mountable on a building for supporting a ladder and protecting the building from damage due to the ladder. The improved device includes a plurality of leg means, attachment means, and crosspiece means that are mountable to a building and act to support a ladder, prevent lateral movement thereof, and protect the building or portions thereof such as gutters or roofs, from damage due to the ladder.

11 Claims, 4 Drawing Sheets

GUTTER GUARD

BACKGROUND OF THE INVENTION

The present invention relates to an improved device for supporting ladders and protecting buildings from damage due to the ladders. Of course, devices designed to be used to support an object or device in spaced relationship to some other structure are known. However, Applicant is unaware of any prior art that includes all of the features of the present invention including a device designed to support a ladder in a spaced relationship to a building to protect the building from damage due to the ladder.

The following prior art is known to Applicant:

U.S. Pat. No. 4,446,945 to Anderson discloses a brace designed to secure a pole to a support surface including a yoke for retaining the pole, the yoke being swivelably connected to a frame member. The teachings of this patent are different from the present invention for reasons including the fact that Anderson does not teach a device capable of supporting a ladder and preventing lateral movement thereof, as is the case in the present invention.

U.S. Pat. No. 2,495,408 to Christoffersen discloses a putlog supporting clip designed to be inserted into a masonry wall for supporting scaffolding. This putlog clip is specially designed to support scaffolds using 2×4's rather than the conventional 4×4's. The teachings of this patent are different from the present invention, in that Christoffersen does not teach a device for supporting a ladder and protecting a building from damage due to the ladder.

U.S. Pat. No. 2,172,796 to Krasin discloses another putlog support device designed to eliminate the problem of leaving spaces in a masonry wall when scaffolding is to be erected adjacent thereto. Again, the present invention is distinct from the teachings of this patent as including a device designed to support and prevent lateral movement of the ladder and to prevent damage to the gutters and roof of a building through use of a ladder.

SUMMARY OF THE INVENTION

The present invention relates to an improved device mountable on a building to support a ladder and to protect the building from damage due to the ladder. The present invention includes the following interrelated aspects and features:

(a) In a first aspect of the invention, the inventive device is made to support a ladder while in use and to protect a building from damage due to the ladder.

(b) The inventive device has first and second leg means to allow mounting of the device at different locations on the building. Also included as part of the device is a crosspiece connected to the first and second leg means for supporting a ladder while in use. Additionally, portions of the first leg means in combination with the crosspiece act to form a chamber to prevent lateral movement of the ladder. Attachment means connect to the first and second leg means to enable the device to be mounted on a building.

(c) Second leg means may include pivotable means connected to the crosspiece and/or attachment means to allow the device of the present invention to be mountable at different locations on a building.

(d) First leg means may be made adjustable in length to enable the inventive device to be mounted at different locations on a building.

Accordingly, it is a first object of the present invention to provide a new and improved device designed to both support a ladder and to protect a building from damage due to a ladder being placed thereagainst.

It is a further object of the invention to have the device contain adjustable and pivotable features to allow the device to be mountable at different locations on the building.

It is a yet further object of the invention to provide a device that has removable portions to facilitate shipping and packaging.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
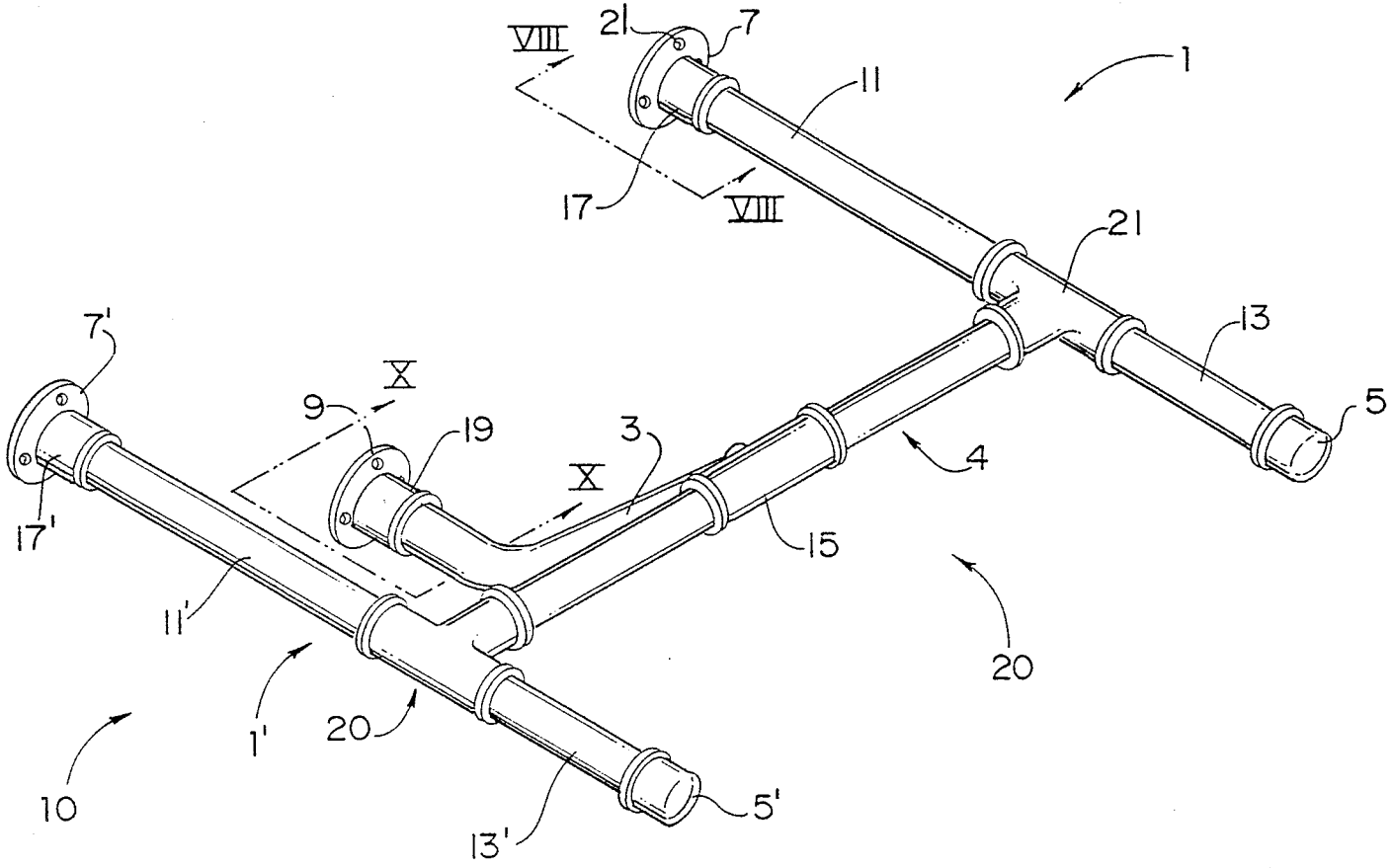
FIG. 1 shows a perspective view of an exemplary embodiment of the present invention.

With reference, firstly, to FIG. 1, the present invention is generally designated by the reference numeral 10 and is seen to include a pair of first leg means 1 and 1', second leg means 3, a crosspiece 4, a pair of caps 5 and 5', a pair of first attachment means 7 and 7', and second attachment means 9. As can be seen from the drawing, each of the first leg means have respective first end portions 11 and 11', each connected at reference numeral 17 and 17' to each of the first attachment means 7 and 7'. A crosspiece 4 is connected adjacent second end portions 13 and 13' of the first leg means 1 and 1' at reference numerals 21 and 22, respectively. Second leg means 3 is seen to connect to the crosspiece 4 at one end, reference numeral 15, with the other end being connected to second attachment means 9 at reference numeral 19. End portions 13 and 13' of the first leg means and crosspiece 4 act to form a chamber generally designated as reference numeral 20, the crosspiece 4 thereof acting as a support for a ladder placed thereon and end portions 13 and 13' acting to prevent lateral movement of the ladder while placed on the crosspiece 4. Finally, caps 5 and 5' attach to each of the end portions 13 and 13, of the first leg means 1 and 1', the caps acting to protect the user of the ladder from injury due to the exposed ends of first leg means 1 and 1'.

First and second attachment means 7, 7' and 9 may be connected to the first and second leg means 1, 1' and 3 in a permanent fashion such that the attachment means 7, 7' and 9 are integral with the leg means 1, 1' and 3. Alternatively, the attachment means 7, 7' and 9 may be removably connected to leg means 1, 1' and 3 to aid in packaging and/or shipping the device of the present invention. Attachment means 7, 7' and 9 are shown with a plurality of mounting openings 21 to enable the attachment means to be fastened to a building using any conventional fastening means such as screws, lag bolts, or the like.

First and second leg means may be of a one-piece design or may be constructed from a plurality of sections. These sections may be connected by any conventional means such as couplings and may be removable from each other or integrally connected. Additionally, the first and second leg means may be fashioned in any desired configuration utilizing either a one-piece design or a plurality of sections. These configurations may include 45-degree or 90-degree bends to allow the device of the present invention to be mountable at different locations on a building.

Second leg means 3 may also be pivotally connected to crosspiece means 4 at reference numeral 15 to allow ease of storage and/or shipping of the device and mounting the device at different locations on a building.

Figure 2:
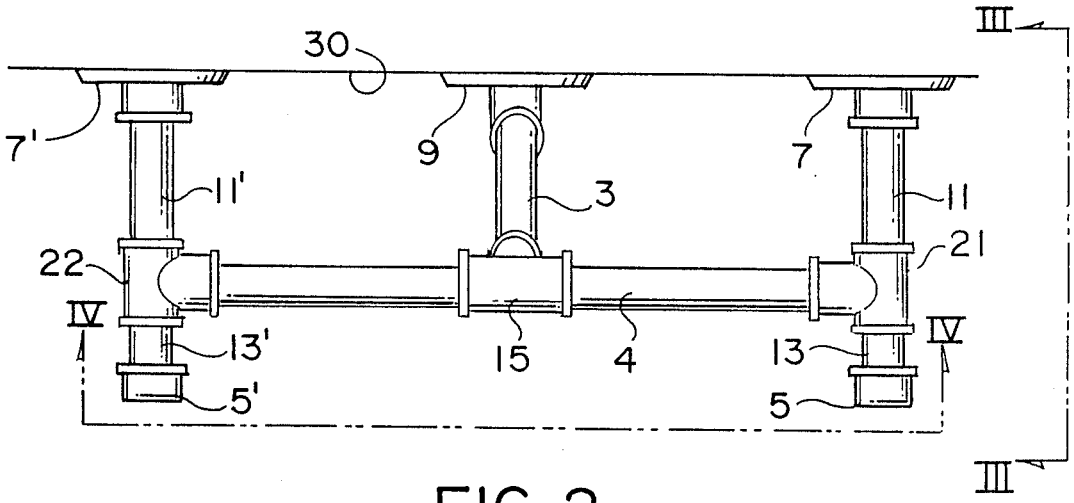
FIG. 2 shows a top view of the device of the present invention mounted on the wall of a building.
Figure 3:
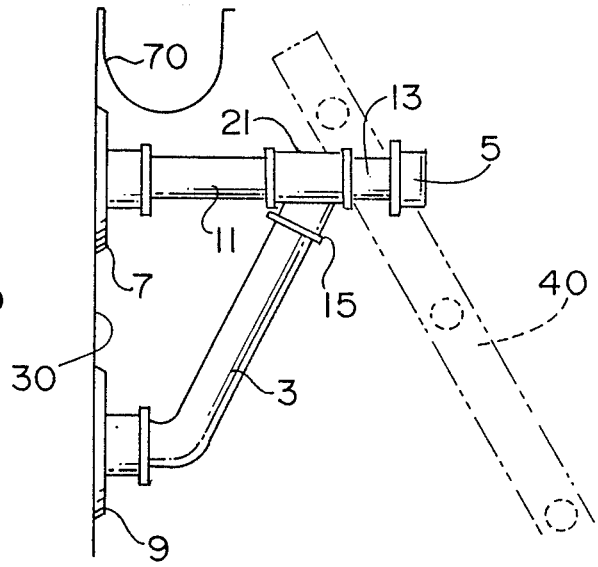
FIG. 3 shows a cross-sectional view along the line III—III of FIG. 2.
Figure 4:
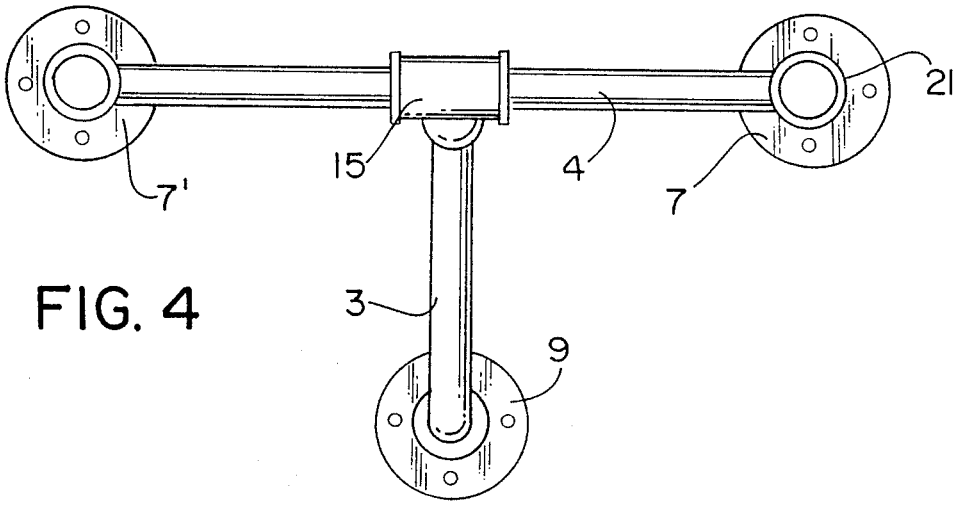
FIG. 4 shows a cross-sectional view along the line IV—IV of FIG. 2.

With further reference to FIG. 2, a top view of the device of the present invention is depicted as mounted to a wall 30 of a building. FIG. 3 shows a cross-sectional view along the line III—III of FIG. 2 depicting the device of the present invention in spaced relationship to a gutter 70 and a ladder 40 (shown in cross-hatch) resting on the crosspiece 4 for support. With further reference to FIG. 4, a cross-sectional view along the line IV—IV of FIG. 2 depicts a front view of the present invention as attached to the wall of a building and more clearly shows the plurality of mounting openings 21 of attachment means 7, 7' and 9.

Figure 7:
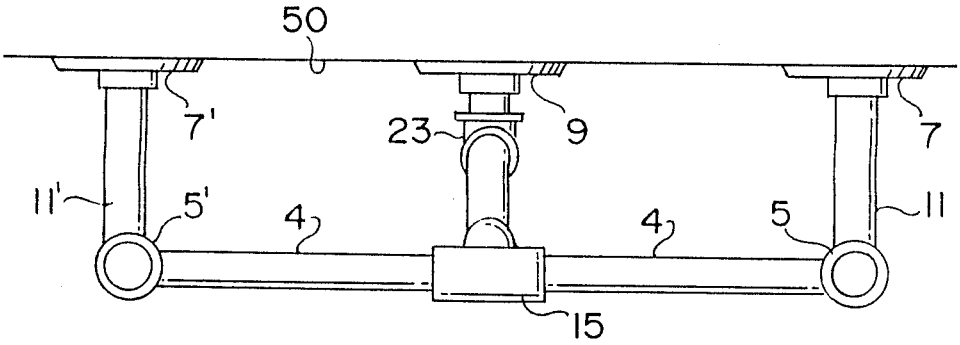
FIG. 7 shows a cross-sectional view along the line VII—VII of FIG. 5.
Figure 5:
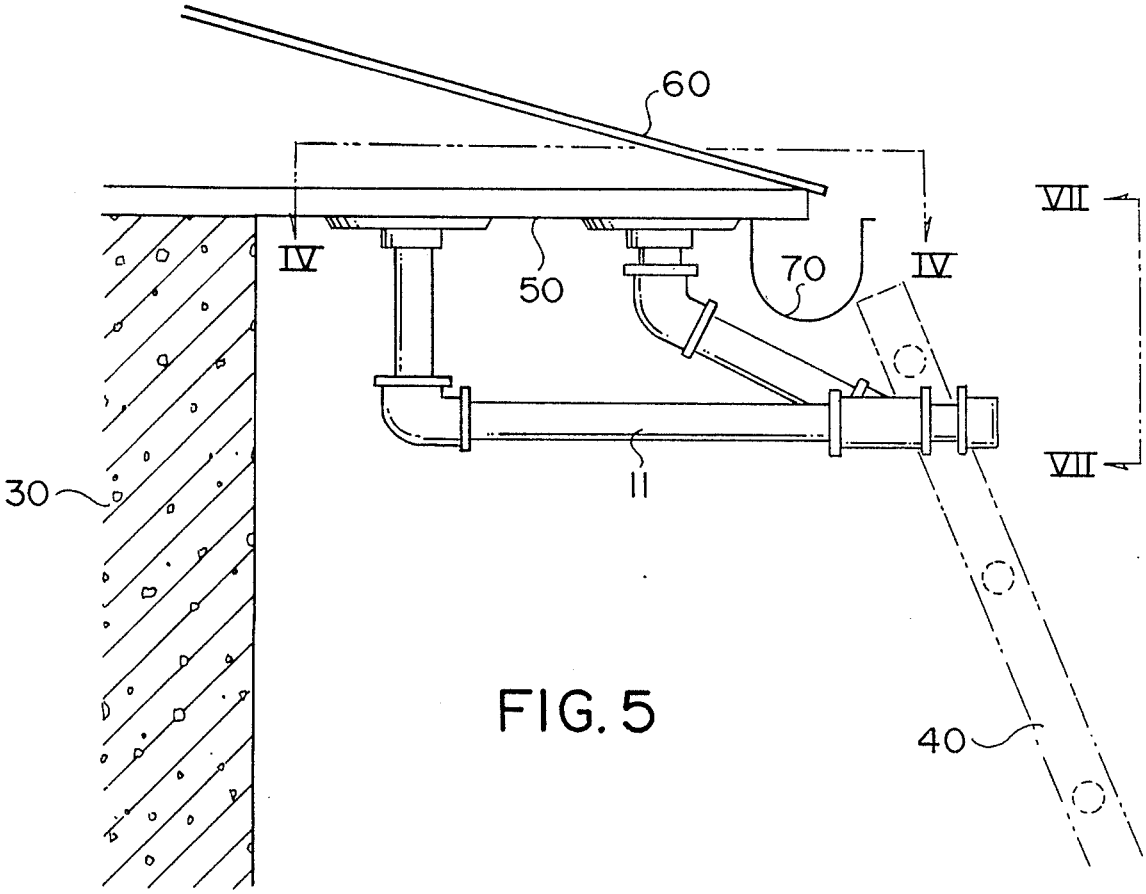
FIG. 5 shows a side view of the device of the present invention mounted on an eave of a building.
Figure 6:
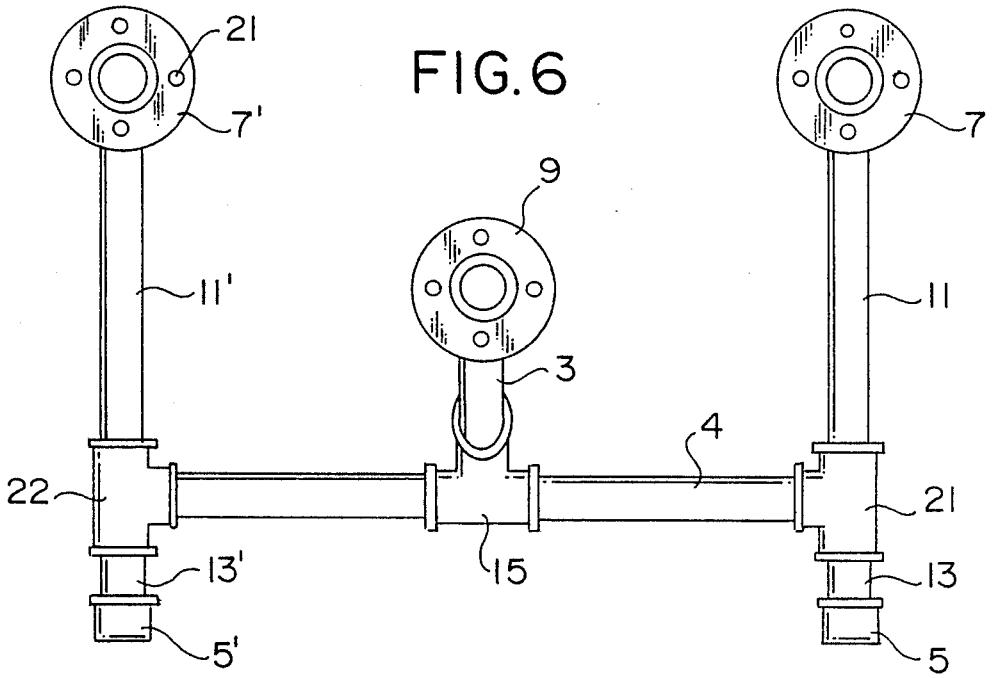
FIG. 6 shows a cross-sectional view along the line VI—VI of FIG. 5.

With reference to FIGS. 5–7, another embodiment of the device of the present invention is depicted wherein the device is mounted on the eave of a building. FIG. 5 shows a side view of the device 10 mounted to an eave 50 of a building with the roof and gutter of the building being designated by reference numerals 60 and 70, respectively. FIG. 5 also depicts in cross-hatch, ladder 40, resting on the device 10, thereby showing how the device of the present invention protects the gutter 70 of a building from damage due to the ladder 40.

FIGS. 6 and 7 show cross-sectional views along the lines VI—VI and VII—VII, respectively, omitting the gutter 70 of FIG. 5, depicting top and front views, respectively, of the device of the present invention as mounted on the eave of a building.

Figure 8:
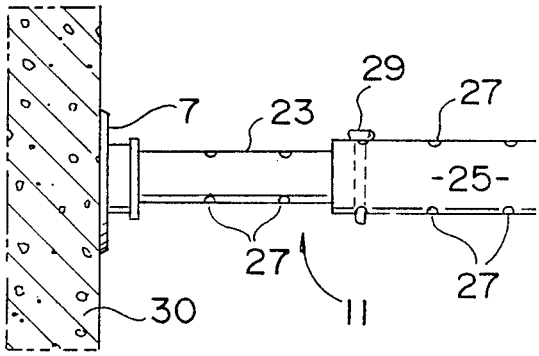
FIG. 8 shows a cross-sectional view along the line VIII—VIII of FIG. 1 of an embodiment of the first leg means of the present invention.

In a further embodiment of the present invention, FIG. 8 shows a cross-sectional view along the line VIII—VIII of FIG. 1 of a type of end portion 11 of first leg means 1 having adjustable length. As can be seen in FIG. 8, hollow end portion 11 is divided into two sections 23 and 25, each section having pairs of aligned openings 27. Section 23 of end portion 11 has a smaller diameter than section 25 of end portion 11 to allow section 25 to slide over section 23 to adjust the overall length of end portion 11. The pairs of aligned openings 27 are aligned in both sections 23 and 25 to allow a pin means 29 to be inserted into aligned openings 27 such that section 25 is securably connected to section 23. Aligning appropriate pairs of openings 27 in sections 23 and 25 allow the length of end portion 11 to be adjusted to enable the device to be mountable at different locations of a building.

Figure 9:
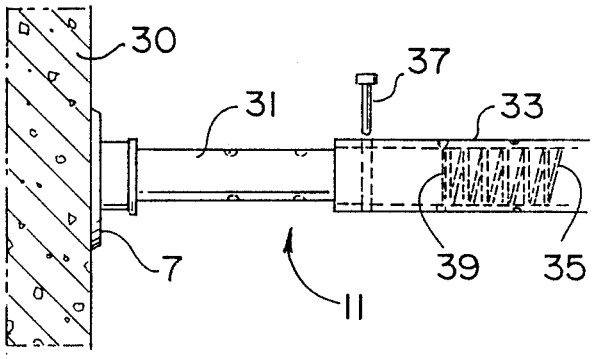
FIG. 9 shows a cross-sectional view along the line VIII—VIII of FIG. 1 of another embodiment of the first leg means of the present invention.

FIG. 9 depicts another embodiment of an adjustable leg means of the device of the present invention as a cross-sectional view along the line VIII—VIII of FIG. 1 and is seen to include hollow end portion 11 of leg means 1 divided into two sections 31 and 33, section 31 having a face 39. The diameter of section 31 is less than the diameter of section 33 such that section 33 may be inserted into section 31. Also included in section 33 are spring means 35, the spring means adapted to be compressed against the face 39 of section 31 by insertion of section 31 into section 33. The length of end portion 11 may be adjusted by inserting section 31 into section 35 until the desired overall length for end portion 11 is achieved. A set screw 37, threadably connected to section 33, may then be tightened such that section 33 is locked in place with section 31.

Figure 10:
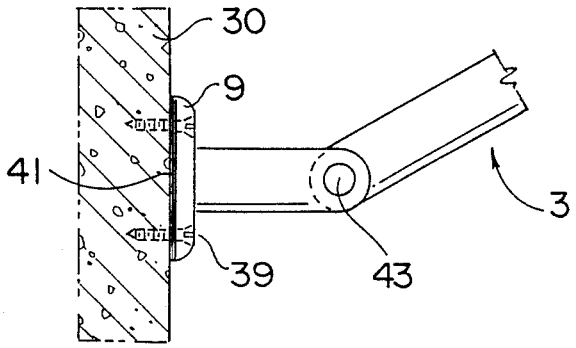
FIG. 10 shows a cross-sectional view along the line X—X of FIG. 1 showing an embodiment of the second leg means of the present invention.

With reference to FIG. 10, a side view of further embodiments of the present invention is shown and is seen to include attachment means 9 having fastening means 39 for mounting the device to a building. Resilient means 41 such as a rubber pad, is located between attachment means 9 and wall 30 to protect the wall from damage due to the attachment means 9. Of course, resilient means 41 may also be utilized with first attachment means 7 and 7'. Leg means 3 is connected to attachment means 9 at a swivel joint 43 to allow the leg means 3 to be mountable at different locations on the building.

The device of the present invention may be made out of any desired material or materials, or in any dimensions. The materials used for the device may be hollow in nature, such as piping, or of solid construction where appropriate, such as a bar, or a combination of both. Preferred materials may include plastic piping such as polyvinyl chloride, PVC, or a galvanized iron piping.

The present invention provides a new and improved device for supporting ladders, preventing lateral movement thereof while in use, and protecting buildings from damage due to the ladder being placed thereagainst. The inventive device may include adjustable and pivotable features that allow the device to be mounted at different locations of the building, such as a wall or an eave.

As such, an invention has been disclosed in terms of a preferred embodiment thereof which fulfills each and every one of the objects of the present invention as set forth hereinabove and provides a new and improved device for supporting ladders of great utility and novelty. Of course, many changes, modifications and alterations in the teachings of the present invention may be contemplated by those skilled in the art without departing from the intended spirit and scope thereof. As such, it is intended that the present invention only be limited by the terms of the appended claims.

I claim:

1. A device mountable on a building for supporting a ladder and protecting said building, comprising:

(a) a pair of first leg means each having first and second end portions;

(b) crosspiece means having opposing ends, each end being connected adjacent a respective said first end portion of said first leg means;

(c) second leg means having opposed ends and being connected to said crosspiece means at one end thereof;

(d) a pair of first attachment means each being connected at a respective said second end portion of a respective said first leg means, said first attachment means adapted to be mounted on said building;

(e) a second attachment means being connected to the other end of said second leg means, said second attachment means adapted to be mounted on said building;

(f) said crosspiece means and said first end portions forming a chamber to support a ladder resting upon said crosspiece, with said chamber preventing lateral movement of said ladder and preventing damage to said building by said ladder.

2. The device of claim 1, wherein said second leg means is pivotably connected to said crosspiece means.

3. The device of claim 1, wherein said second attachment means connects to said second leg means at a swivel joint, said swivel joint allowing mounting of said device on a variety of locations on said building.

4. The device of claim 1, wherein said first leg means are adjustable in length to allow mounting of said device on different locations of said building.

5. The device of claim 1, wherein said first and second attachment means include a resilient material engageable with said building to protect a surface of said building.

6. The device of claim 1, wherein said first and second attachment means are removable from said first and second leg means.

7. The device of claim 1, wherein said crosspiece means is removable from said second leg means and from each respective said first end portions of said first leg means.

8. The device of claim 1, wherein said building has a side wall, a gutter and a roof, said device being attachable to said side wall.

9. The device of claim 1, wherein said building has an eave and said device is attachable thereto.

10. The device of claim 1, wherein said first and second end portions of said first leg means are separable from each other.

11. The device of claim 1, wherein said first end portions of each of said first leg means each include cap means adapted to fit over each respective said first end portion for protecting a user of said ladder.

* * * * *